United States Patent [19]

Manley, Jr. et al.

[11] Patent Number: 4,906,130

[45] Date of Patent: Mar. 6, 1990

[54] ANTI-SCOURING DEVICE FOR A DAM STILLING BASIN OR APPROACH

[75] Inventors: Thomas L. Manley, Jr., Coraopolis; Everald V. Wright, Pittsburgh, both of Pa.

[73] Assignee: Davy McKee Corporation, Pittsburgh, Pa.

[21] Appl. No.: 224,798

[22] Filed: Jul. 26, 1988

[51] Int. Cl.[4] ..... E02B 3/14

[52] U.S. Cl. ..... 405/15; 405/17; 405/20

[58] Field of Search ..... 405/20, 17, 107, 116, 405/228, 211, 73, 15, 21, 16, 29, 205, 204, 222

[56] References Cited

U.S. PATENT DOCUMENTS

| | | | |
|---|---|---|---|
| 904,030 | 11/1908 | Walther | 405/275 X |
| 1,048,251 | 12/1912 | Wilkinson | 405/16 |
| 1,352,429 | 9/1920 | Clarke | 405/16 |
| 1,822,603 | 9/1931 | Ross | 405/20 X |
| 1,983,772 | 12/1934 | Pierson | 405/20 |
| 2,159,685 | 5/1939 | Buzzell | 405/20 |
| 3,347,048 | 10/1967 | Brown | 405/16 |
| 3,386,252 | 6/1968 | Nelson | 405/20 |
| 3,919,850 | 11/1975 | Coone | 405/205 |
| 4,102,147 | 7/1978 | Jansz | 405/228 |

FOREIGN PATENT DOCUMENTS

| | | | |
|---|---|---|---|
| 0462034 | 3/1927 | Fed. Rep. of Germany | 405/73 |
| 2230212 | 10/1974 | Fed. Rep. of Germany | 405/16 |
| 1063854 | 4/1953 | France | 405/16 |
| 0033915 | 2/1987 | Japan | 405/16 |
| 0258116 | 7/1970 | U.S.S.R. | 405/20 |

*Primary Examiner*—Randolph A. Reese
*Assistant Examiner*—Arien L. Olsen
*Attorney, Agent, or Firm*—Parmelee, Miller, Welsh & Kratz

[57] ABSTRACT

An anti-scouring device for preventing scouring of the bed of a flowing stream at an upstream or downstream location proximate a dam has a plurality of rows of concrete members, positioned in the direction of flow of the stream, on the bed of the stream. The concrete members have a base and at least one downwardly extending penetrating member which secures the member to the bed. The concrete members may have downwardly extending legs and upwardly extending retention posts and be linked together in the rows by a flexible linkage. Or, the concrete members may have downwardly extending intersecting webs to serve in securing the members to the bed. Methods for forming the anti-scouring device on the bed are also provided.

2 Claims, 5 Drawing Sheets

ANTI-SCOURING DEVICE FOR A DAM STILLING BASIN OR APPROACH

FIELD OF THE INVENTION

The present invention relates to an anti-scouring device for preventing the scouring of the bed of a flowing stream of water at a location proximate the approach or upstream end of a dam, or the downstream end of a dam, or stilling basin, and a method for forming such an anti-scouring device.

BACKGROUND OF THE INVENTION

The area of a river, or stream, that is adjacent the upstream or downstream end of a dam constructed across the river, where flow over the dam is permitted, is subject to serious scouring or erosion by the flow of water. The flowing water, as it approaches and passes over the dam, creates currents and turbulence in these areas known as the approach and the stilling basin and the turbulence, as well as media carried by the water, scours the bed of the river. Such continuous scouring, over a prolonged period of time can create a large cavity in the river bed, either upstream or downstream of the dam with the cavity eventually reaching such proportions that the structural integrity of the dam immediately adjacent to the cavity, can be threatened. While it has been proposed to place a deposit of riprap, or large size rocks, in the stilling basin to reduce erosion of the river bed, such riprap is itself subject to the forces of the flowing water, and debris therein, and may eventually be displaced or dispersed such that the river bed is subsequently exposed to erosion, at least in areas where the riprap deposit has been disturbed.

It is an object of the present invention to provide an anti-scouring device for an approach and stilling basin that is stable under the influence of the forces acting upon the device.

It is another object of the present invention to provide an anti-scouring device for an approach or stilling basin that can be formed from precast concrete members that can be cast at a location remote from a river and precisely located in the approach or stilling basin, without dewatering the same.

SUMMARY OF THE INVENTION

An anti-scouring device for preventing the scouring of the bed of a flowing stream at a downstream location from a dam has a plurality of rows of concrete members positioned, preferably, in a concave depression formed in the downstream bed of the stream, or on a leveled or slightly inclined manner for preventing scouring of the upstream bed at the approach. The rows of concrete members are positioned in the direction of the stream flow, while each row is aligned transverse to adjacent rows and the direction of the stream and parallel to the dam. The concrete members have a base and at least one downwardly extending penetrating member on the base which secures the concrete member to the bed of the stream.

In one embodiment, the concrete members have at least one downwardly depending leg which serves as the securing means to penetrate the bed of the stream and at least one upwardly extending retention post which serves to retain riprap on the concrete members against the scouring forces of the rushing water. Preferably, the concrete members are rectangular in shape and have a downwardly depending leg and upwardly extending retention post adjacent each corner. The concrete members of each row are linked together in the rows by flexible linking means, such as by use of hairpin anchors embedded in the sidewall of the base thereof and a link chain or link bar connecting hairpin anchors of adjacent concrete members. After a first row of the concrete members is positioned on the stream bed, subsequent rows are placed in a substantially abutting relationship. When positioning the rows of linked concrete members, the same may be transported to the desired position between two spaced barges and a hoist, or other lowering means, on the barges used to lower the row to a predetermined position.

In another embodiment, the concrete members have a base and a plurality of downwardly extending intersecting webs which serve to penetrate and secure the concrete members to the bed of the stream. In this embodiment, the concrete members are of a size that the use of barges is not practical, and each of the concrete members are floated to desired position using flotation tanks and flotation control tubes that are releasably secured to the base. After correct positioning, the flotation tanks are flooded and the concrete member is lowered to the bed of the stream. The flotation tanks and flotation control tubes are then released from the base and removed from the area of the device.

BRIEF DESCRIPTION OF THE DRAWINGS

The present invention will become more readily apparent by reference/to the accompanying drawings wherein.

DETAILED DESCRIPTION

Figure 1:
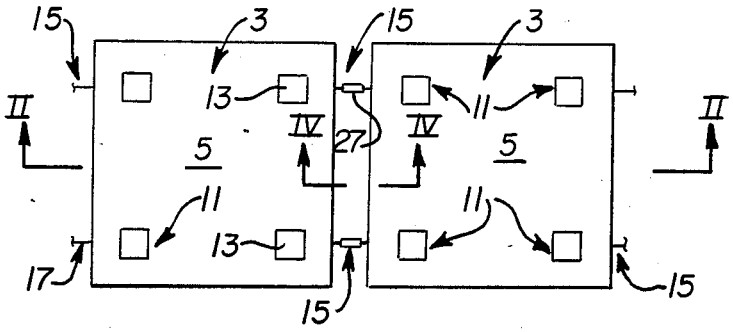
FIG. 1 is a plan view of a portion of a row of concrete members of one embodiment of the present invention for use in forming an anti-scouring device of the invention.
Figure 2:
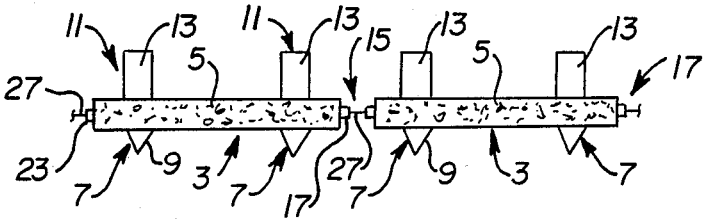
FIG. 2 is an elevational sectional view taken along the lines II—II of FIG. 1.
Figure 3:
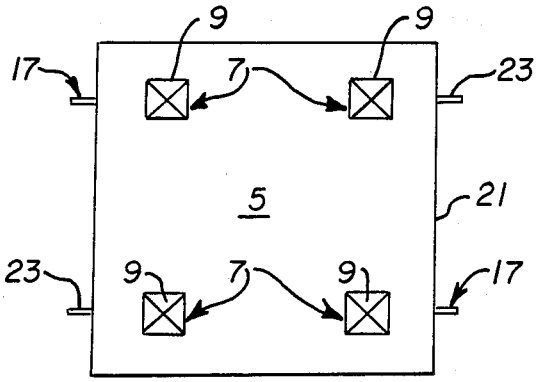
FIG. 3 is a bottom plan view of a concrete member as illustrated in FIG. 1.

The present invention provides an anti-scouring device for either the immediate upstream area or approach to a dam, or the immediate downstream area or stilling basin. While it is understood that the invention is for use at an approach or stilling basin, for the purpose of brevity the stilling basin will be referred to in the following description.

Referring now to FIGS. 1 to 4, one embodiment of a concrete member is illustrated for use in the anti-scouring device 1 of the present invention. A concrete member 3 has a base 5, and at least one downwardly extending member 7 for penetrating and engaging the bed of a stream. In the embodiment illustrated, the base is in the form of a rectangle and four downwardly extending members are provided, in a shape of a pyramid 9, one adjacent each corner of the rectangular shaped base. There is also provided on the base 5, at least one upwardly extending retention post 11. In the embodiment illustrated, with a rectangular base, upwardly extending retention posts 11 in the form of columns 13 are provided, one adjacent each corner of the rectangular shaped base.

Figure 4:
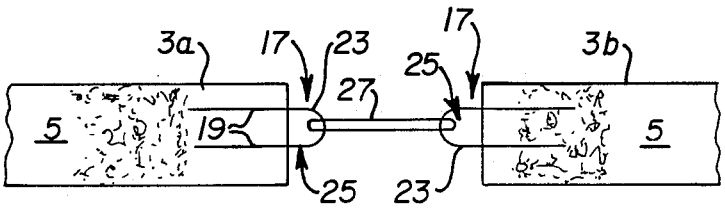
FIG. 4 is an enlarged view of a linking means used to link together adjacent concrete members of a row of the concrete members.

In order to better place the concrete members in rows, and retain them in adjacent relationship after placement, the adjacent concrete members 5 in each row are linked together. Flexible linking means 15 are used to link adjacent concrete members together. As best illustrated in FIG. 4, a preferred flexible linking means 15 comprises an anchor such as a hairpin anchor 17 having at least one, preferably a pair of legs 19 which are embedded in a side wall 21 the concrete base 5 and extend from the side wall 21 thereof, with the curved portion 23 of the hairpin anchor exposed to provide a closed loop 25. A link bar or link chain 27 is passed through or clamped over adjacent closed loops 25 and links the two adjacent concrete members 3*a* and 3*b* to each other. The flexible linking means 15 is preferably formed from stainless steel or other material that will provide for resistance to corrosion from reaction with flowing water, or soil, in the stream 31. In the embodiment of concrete members 3, it is envisioned that the base 5, when rectangular in shape will normally have a dimension of between about 10 feet to 15 feet in both width and length, preferably a square shape of between 10 to 15 feet square, with the base 5 thereof being of a thickness of about 2 feet or less and the downwardly extending members 9 and upwardly extending retention posts 11 extending a distance of about 2 feet or less from the base 5 such concrete members 3 can be formed as precast concrete elements that may be cast at a remote location, and are large, flat bases with the extensions thereon.

Figure 5:
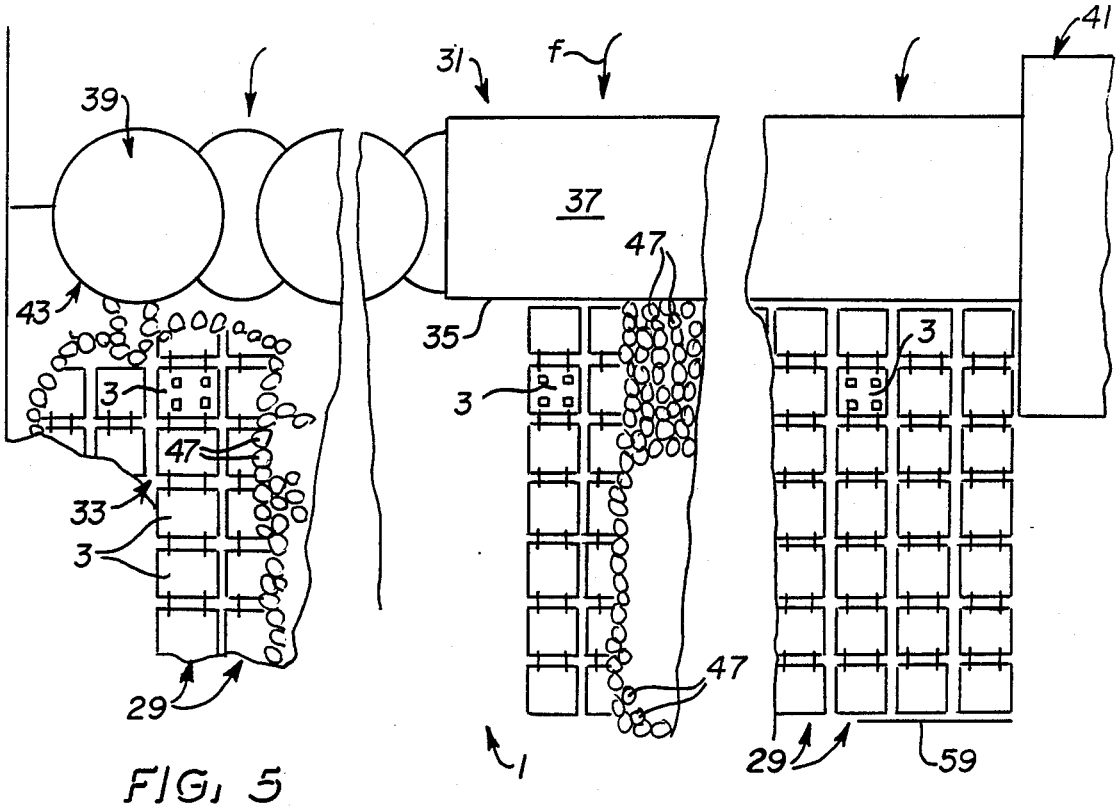
FIG. 5 is a partial plan view of one embodiment of the anti-scouring device of the present invention positioned in a stream proximate the downstream end of a dam.

An anti-scouring device 1 of the present invention, using the linked concrete members 3 illustrated in FIGS. 1 to 4 is shown in a plan view in FIG. 5. The anti-scouring device 1 comprises a plurality of rows 29 of the concrete members 3 positioned in the direction of flow of a stream 31, as indicated by the arrows f, the rows 29 of concrete members 3 positioned on the bed 33 of the stream 31 downstream from and proximate the downstream end 35 of a dam 37, in the area generally described as the stilling basin. The plurality of rows 29 of the concrete members 3 are aligned in a direction transverse to the flow of the stream and substantially parallel to the dam 37, along substantially the length of the dam 37. The dam 37 will normally extend across the stream 31 between an abutment, such as a non-overflow weir or other barrier 39 to a distant abutment such as a lock wall 41, as illustrated in FIG. 5. The anti-scouring device 1, as illustrated may extend to a location downstream and proximate the downstream end 43 of the abutment or barrier 39, as well as the dam 37.

Preferably, before placement of the anti-scouring device on the bed 33 of the flowing stream 31, a depression 45 (FIG. 6) is formed in the bed 33 of the stream 31, such as by dredging, and the rows 29 are placed along the depression 45 to form a concave shape. After placement of the rows 29 of concrete members 3, riprap 47 is deposited on the concrete members 3, which riprap is retained by the upwardly extending retention posts 11. The anti-scouring device 1 comprises a stable device that contains some flexibility due to the flexible linking means 15 between adjacent concrete members 3, thus accommodating irregularities in the surface 33 of the stream 31.

Figure 6:
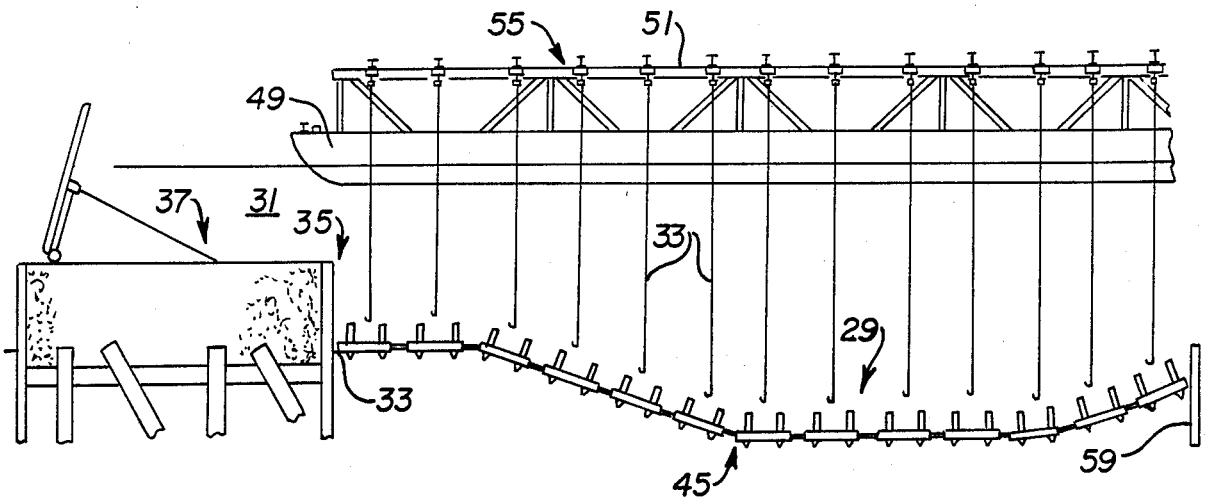
FIG. 6 illustrates schematically the use of a barge for placing a row of concrete members in a depression formed in the bed of a stream.
Figure 7:
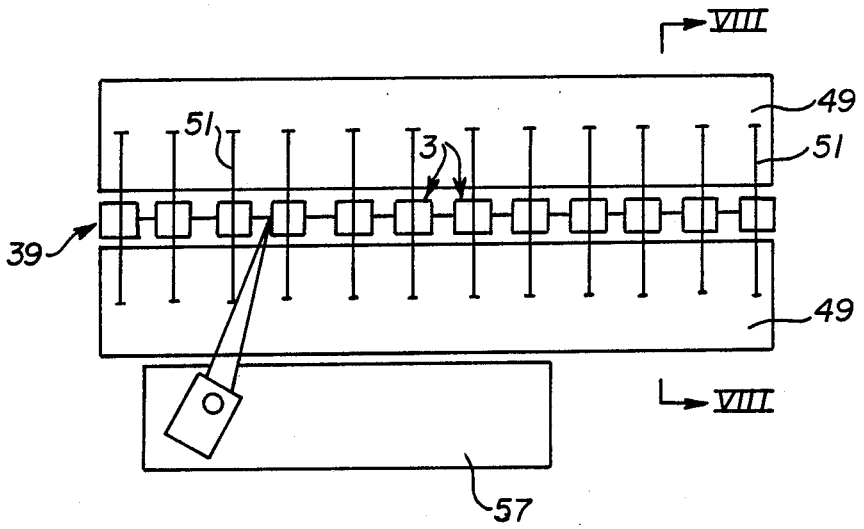
FIG. 7 is a plan view of the placement of row of concrete members as shown in FIG. 6 using two barges and a structural framework therebetween.
Figure 8:
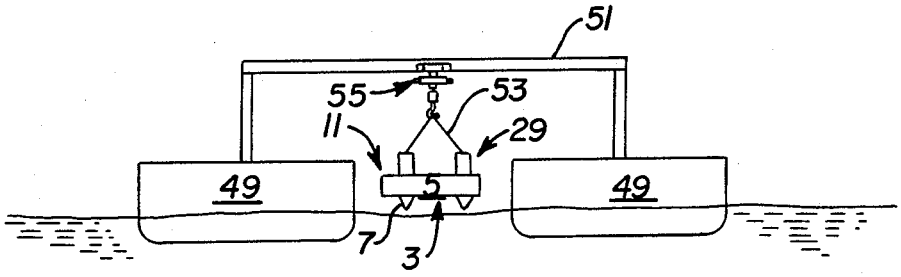
FIG. 8 is a view taken along lines VIII—VIII of FIG. 7.

A method of forming the anti-scouring device 1 on the bed 33 of a stream 31 is illustrated in FIGS. 6 to 8. Rows 29 of concrete members 3 can be formed distant from the area of placement and transported to the desired area by the use of barges, for example a pair of spaced lay barges 49 having a support framework 51 extending therebetween, the framework 51 sufficiently strong to support a row 29 of concrete members 3 by use of cables 53 and winches 55. A service derrick vessel 57 may be used to assist in placement of the row 29 of concrete members 3. As best shown in FIG. 6, row 29 of concrete members 3 is lowered from the support framework 51 between barges 49 by the winches 55 and cables 53 to position the row at a predetermined location on the bed 33 of the flowing stream 31, preferably in a depression 45 formed in the bed 33. If desired, a downstream barrier 59 of sheet pile may be driven into the bed 33 immediately downstream of the downstream concrete members of the anti-scouring device 1 to further protect against erosion and attendant settlement in the area.

Figure 11:
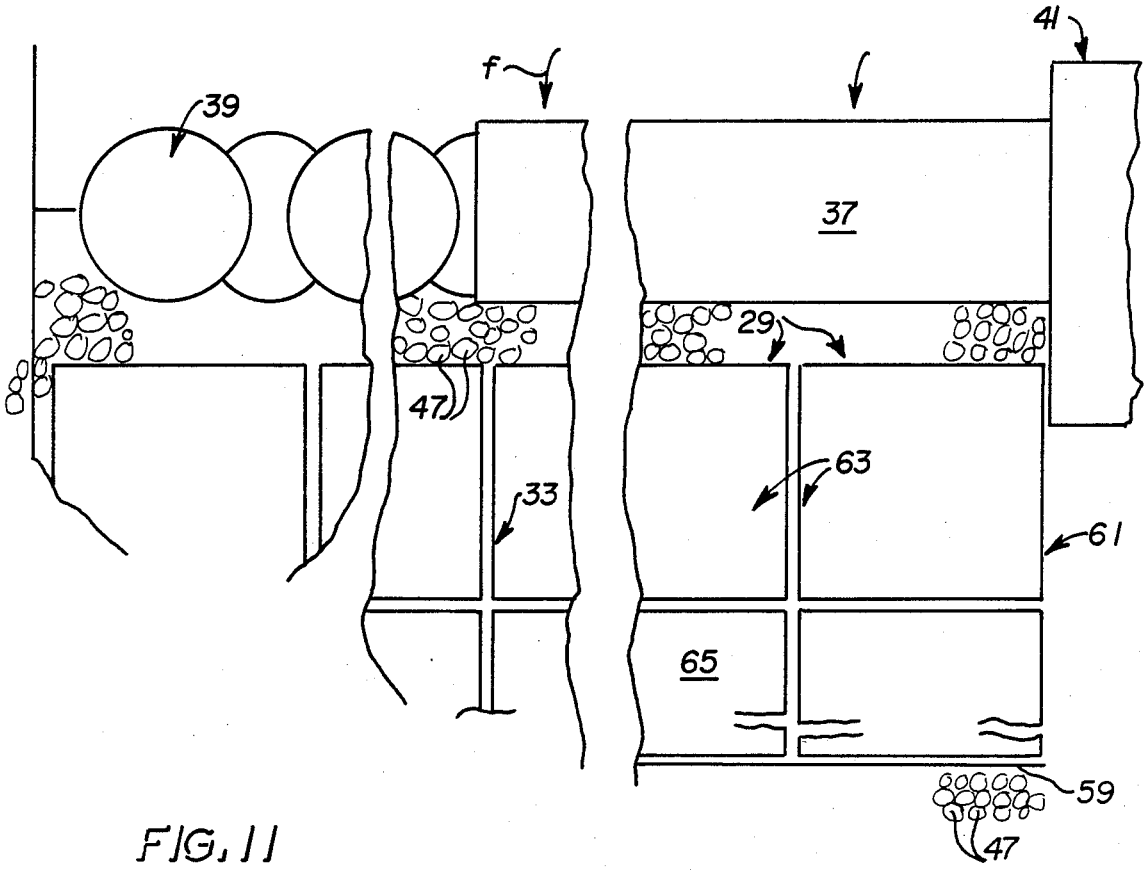
FIG. 11 is a partial plan view of an embodiment of the anti-scouring device of the present invention, using concrete members illustrated in FIG. 9, in a stream proximate the downstream end of a dam.
Figure 9:
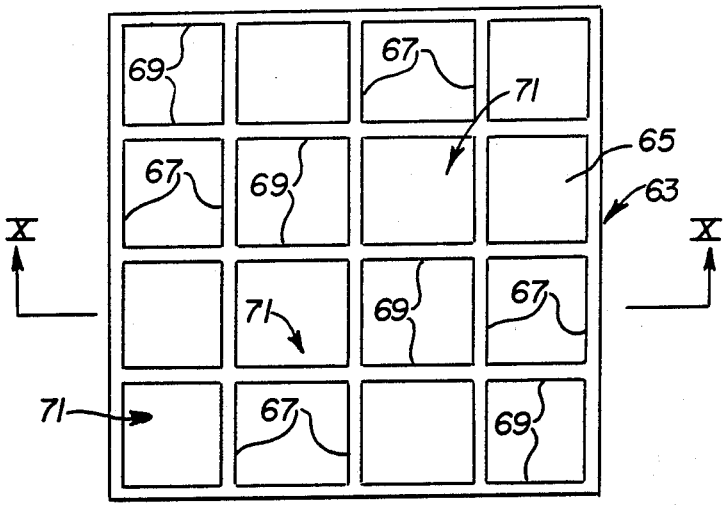
FIG. 9 is a bottom plan view of another embodiment of a concrete member of the present invention for use in forming another embodiment of an anti-scouring device of the invention.
Figure 10:
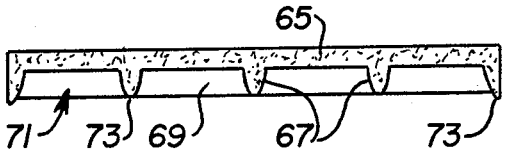
FIG. 10 is a cross-sectional view taken along the lines X—X of FIG. 9.

Another embodiment of a concrete member for use in a further embodiment of an anti-scouring device 61 of the present invention is illustrated in FIGS. 9 to 11. A concrete member 63 has a base 65 and a plurality of intersecting downwardly extending webs 67, 69, which form pockets 71 therebetween. The plurality of intersecting downwardly extending webs 67 and 69 preferably narrow in cross-sectional dimension from the base 65 so as to provide penetrators for the bed, such as pointed or rounded bottom edges 73. The webs 67 and 69 are provided so as to engage and penetrate the bed 33 of stream 31 and also provide reinforcing ribs for the base 65, since such concrete members are cast as integral structural units.

The anti-scouring device 61 is illustrated in position on the bed 33 of stream 31 at a location proximate the downstream end of a dam 37, and also downstream of the downstream end 43 of an abutment, such as a non-overflow weir 39 in FIG. 11. In the embodiment also, a sheet pile downstream barrier 59 may be driven into the bed 33 of stream 31 at a location immediately downstream of concrete members of the anti-scouring device 61.

Figure 12:
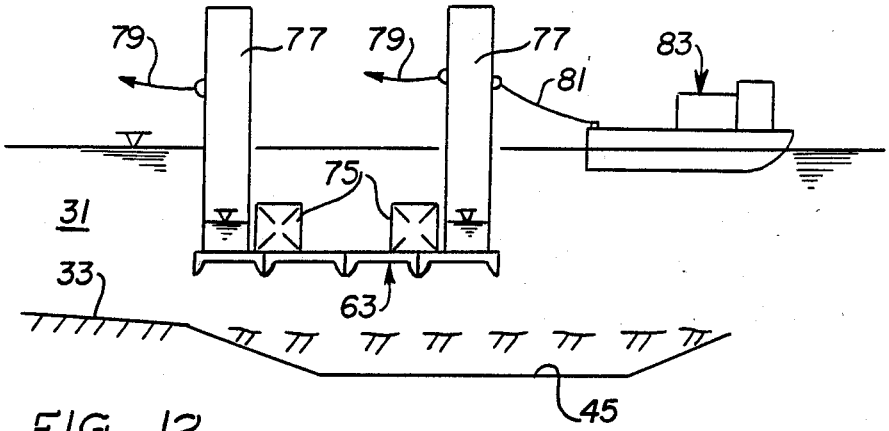
FIG. 12 illustrates schematically the flotation of a concrete member illustrated in FIG. 9 to a position above a depression in the bed, of a stream for placement thereon.
Figure 13:
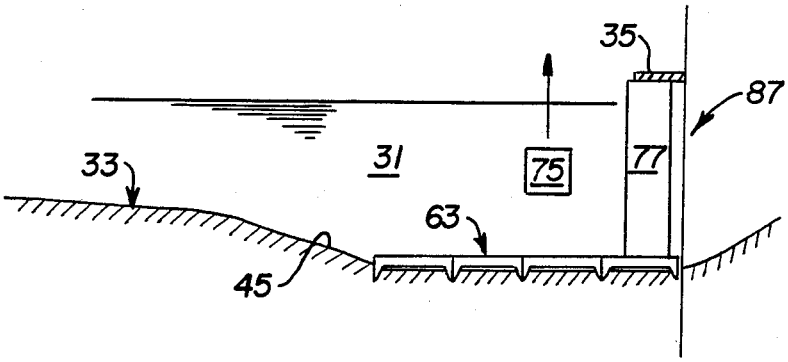
FIG. 13 is a view similar to FIG. 12 showing removal of a flotation tank and use of a flotation control tube as a template support for alignment of sheet pile to form a downstream sheet pile barrier for the anti-scouring device.
Figure 14:
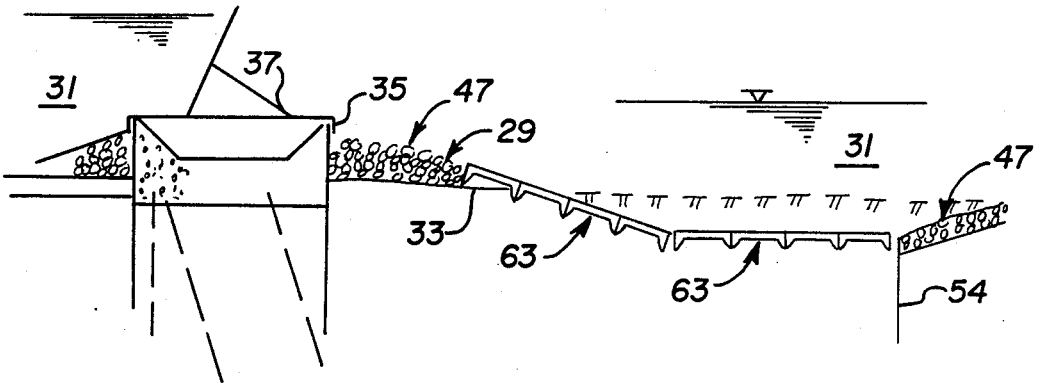
FIG. 14 illustrates in elevational cross-section of an anti-scouring device using the concrete members of FIG. 9.

A method of forming the anti-scouring device 61 on the bed of a stream 31 is illustrated in FIGS. 12 to 14. Because of the large size and resultant weight of the concrete members 63, the base of which would generally be on the order of 50 feet square or larger, placement of rows of such members at a single step would be impractical or unworkable. Such concrete members 63 would have a base 65 of a thickness of about 2 feet or less, with the webs 67, 69 extending a distance of about 4 feet or less from the base, providing a relatively large and flat base with the extensions.

Referring now to FIG. 12, a concrete member 63 has releasable secured thereto flotation tanks 75 and also flotation control tubes 77. Using the flotation tank 75, the concrete member 63 may be floated to a desired location, such as above a depression 45, formed in the stream bed 33 by dredging. The flotation control tubes 77 may be used for attachment of horizontal positioning control lines 79 which are attached to an upstream support such as a support post on the dam or piers for the dam (not shown), while also controlled by vessel lines 81 attached to a control vessel 83. The concrete member 63 is then lowered to the bed, by progressively filling the flotation tanks 75 and flotation control tubes 77 in a predetermined manner for fine vertical control, and the flotation tank 75 and flotation control tubes 77 released therefrom and removed from the area of the anti-scouring device 61. After lowering of a concrete member 63 at the downstream end of the anti-scouring device 61, it may be desirable to drive a sheet pile downstream barrier 59 into the bed 33 of the stream 31 adjacent the concrete member 63. As shown in FIG. 13, prior to release and removal of a flotation control tube 77 from the concrete member 63, a template 85 may be secured to the flotation control tube 77 and used as a guide and support for driving of the sheet pile, illustrated as 87, into the bed 33. Upon final placement of the rows 29 of concrete members 63, riprap 47 may be deposited on the bed 33 between the upper edge of the row 29 and the downstream end 35 of the dam 37, while further riprap 47 may be deposited on the bed 33 immediately downstream of the sheet pile barrier 59.

What is claimed is:

1. An anti-scouring device for preventing the scouring of the bed of a flowing stream of water at a location proximate the upstream or downstream end of a dam comprising:

a plurality of rows of concrete members, each said concrete member having a rectangular base, four integral upwardly extending retention posts on said base, one adjacent each corner of said rectangular base, four downwardly extending members in the shape of pyramids for engaging the bed of said stream, one adjacent each corner of said rectangular base; positioned in the direction of flow of said stream, said rows aligned in a transverse direction to said flow, in substantially abutting relationship;

flexible linking means provided to link adjacent concrete members of a said row in adjacent relationship, comprising hairpin anchors having at least one leg embedded in said concrete member and a curved portion thereof exposed to provide a closed loop, and link chains passed through adjacent closed loops of adjacent concrete members;

said rows positioned on the bed of said stream proximate said dam; and a supply of riprap disposed on the concrete members and retained thereon by said upwardly extending retention posts.

2. The anti-scouring device as defined in claim 1 including a sheet pile barrier driven into the bed of said stream immediately downstream of the concrete members.

* * * * *